US007297185B2

(12) United States Patent
Furuta et al.

(10) Patent No.: US 7,297,185 B2
(45) Date of Patent: Nov. 20, 2007

(54) ELECTROSTATIC DUST PRECIPITATOR

(75) Inventors: Masatoshi Furuta, Kakamigahara (JP); Shigenobu Ohkura, Komaki (JP)

(73) Assignees: Zesu Giko Co., Ltd., Kakamigahara-shi (JP); Hidec Co., Ltd., Komaki-shi (JP)

( * ) Notice: Subject to any disclaimer, the term of this patent is extended or adjusted under 35 U.S.C. 154(b) by 0 days.

(21) Appl. No.: 11/465,450

(22) Filed: Aug. 18, 2006

(65) Prior Publication Data

US 2006/0275651 A1 Dec. 7, 2006

(51) Int. Cl.
*B03C 3/10* (2006.01)

(52) U.S. Cl. ..... 96/39; 96/44; 96/50; 96/64; 96/76; 96/94; 96/97

(58) Field of Classification Search ..... 96/29, 96/39, 44, 46, 50, 57, 58, 64, 76, 94, 97; 95/75, 77

See application file for complete search history.

(56) References Cited

U.S. PATENT DOCUMENTS

| | | | | | |
|---|---|---|---|---|---|
| 640,694 | A | * | 1/1900 | Otto | 422/186.07 |
| 1,396,811 | A | * | 11/1921 | Chubb | 95/77 |
| 1,481,970 | A | * | 1/1924 | Welch | 96/39 |
| 2,615,529 | A | * | 10/1952 | Lincoln | 96/46 |
| 3,918,939 | A | * | 11/1975 | Hardt | 96/99 |
| 4,093,432 | A | * | 6/1978 | Ahlrich | 96/78 |
| 5,084,077 | A | * | 1/1992 | Junker et al. | 96/39 |
| 5,221,297 | A | * | 6/1993 | Childress et al. | 95/75 |
| 5,380,355 | A | * | 1/1995 | Brothers | 96/64 |
| 5,429,669 | A | * | 7/1995 | Chang | 96/51 |

FOREIGN PATENT DOCUMENTS

| | | | | | |
|---|---|---|---|---|---|
| EP | 0496092 | A2 | * | 7/1992 | 96/44 |
| JP | 50-50770 | A | * | 5/1975 | |
| JP | 6-142548 | A | * | 5/1994 | 96/44 |
| JP | 2003-126729 | A | * | 5/2003 | |
| JP | 2003-144969 | A | * | 5/2003 | |

* cited by examiner

*Primary Examiner*—Richard L. Chiesa
(74) *Attorney, Agent, or Firm*—Apex Juris, pllc; Tracy M. Heims

(57) ABSTRACT

An electrostatic dust precipitator (1) is constructed mainly to include a housing (11) in which an air path (10) communicating between an inlet (8) and an outlet (9), an airstream generating unit (14) that causes generation of an airstream in the air path (10), a discharging unit (2) and a discharge guide unit (3) that charge fine particulate (103) with a corona discharge (100), a charging unit (4) that causes the fine particulate (103) charged with the corona discharge (100) to repel in accordance with a coulomb force, an attracting unit (5) that allows the fine particulate (103) to be attracted in accordance with the coulomb force and that thereby collects the fine particulate (103), a voltage supply unit (15) that supplies a discharge voltage for generation of the corona discharge (100) and for repelling by the charging unit (4) in accordance with the coulomb force, and a drive controller unit (20) that causes rotational driving of discharge plates and attracting plates.

6 Claims, 5 Drawing Sheets

ELECTROSTATIC DUST PRECIPITATOR

TECHNICAL FIELD

The present invention relates to an electrostatic dust precipitator, and more specifically to an electrostatic dust precipitator capable of collecting an electrically charged fine particulate by using a rotary attracting plate.

BACKGROUND ART

Conventionally, there are cases where, before emitting of so-called "industrial waste gases", such as exhaust gases of boilers in factories and smoke massively emanated from power generating plants, into the atmosphere, air purification processing is performed to remove various types of fine particulates contained in the industrial waste gases, such as mist and dust containing, for example, powders containing oil, moisture, and/or the like, which can pollutes the atmosphere. Direct emission of the industrial waste gases containing the fine particulate into the atmosphere significantly affects the global environment, so that there are cases where it is obligatory to perform collection thereof by standards of a nation or local governments. In addition, in municipal regions, air pollution resulting from, for example, automobile exhaust gases, is a serial issue, and thus even ordinary homes have and use an air cleaning apparatus. Further, in many sites, such as kitchens of restaurants, there are air cleaning apparatuses for cleaning air before emitted to the outside, for example, polluted air and smoke generated during cooking or the like.

As a dust collector that is used to collect fine particles contained in polluted air which causes air pollution and to carry out purification to clean air, there are known various types classified according to a dust collection principle. More specifically, in term of the collection principle, the apparatuses can be classified into types, such as filtration, gravitational, inertial, centrifugal, dust precipitation, and washing types. They are appropriately selected for practical use depending on, for example, the size and type of fine particulate to be collected, and/or the installation conditions of the apparatuses. In particular, of the types described above, the filtration type (using a bug filter or the like) and the dust precipitation type are excellent from the viewpoint of the dust collection capability, and thus they are widely used in various industrial fields.

The dust collection principle of electrostatic dust precipitators is such that electric charges are supplied to the fine particulate through corona discharges generated from discharge electrodes, and coulomb forces are used to electrostatically attract the charged fine particulate onto collector electrodes which are opposed electrodes, whereby the fine particulate is collected. As features, the electrostatic dust precipitator has significant advantages, such as: 1) the pressure loss is small; 2) a large amount of gases is can be processed; and 3) the collection efficiency is high. Therefore, electrostatic dust precipitators are used in such environments as factories and power generating plants which emit a large amount of polluted air.

Generally, a main construction of an electrostatic dust precipitator includes discharge electrodes each formed into a shape having a large surface curvature, such as a needle or wire material, for generating corona discharges for supplying electric charges to the fine particulate; collector electrodes, as opposed electrodes, each formed into a flat plate for collecting the charged fine particulate; a rectifier unit for rectifying the flow of gas streams in the electrostatic dust precipitator; a dust removal device (dry type) or a spray device (wet type) for separating deposited fine particulate from the collector electrodes; a hopper for collecting the separated fine particulate; and a power system and electric charge control device provided as appendages to cause corona discharges. The dust removal unit is used with a dry electrostatic dust precipitator and is used in such a manner that the collector electrodes are rapped by a hammer or the like to dislodge collected fine particulate therefrom, thereby to store the fine particulate into a collection unit, such as a hopper, provided in a lower portion. In the wet type, fine particulate collected onto the collector electrodes is washed and removed with injected cleaning solution, such as water. In a state where a large amount of the fine particulate is collected onto the collector electrodes, the coulomb force for attracting the charged fine particulate may be reduced, thereby reducing the collection efficiency. Therefore, in order to prevent the case where the dust collection cannot be performed in a stable state, the dry and wet types are used to remove the fine particulate from the collector electrodes.

In addition, in recent years, there has been deployed an apparatus of the type in which discharge electrodes and collector electrodes are housed in a cartridge so that the cartridge is replaceable. According to this type, when a large amount of the fine particulate has been deposited onto the collector electrodes to the extent of reducing the collection efficiency, the collection efficiency can be maintained constant by replacement of the cartridge. In many cases, used cartridges undergo removal of the fine particulate in, for example, dedicated facilities installed in a maker, to be reusable. Thereby, the maintenance operations of apparatuses are facilitated; and in addition, since removal facilities such as described above need not be provided, the apparatus can be downsized. Consequently, the manufacturing cost can be reduced.

However, as already described, in the case of dry and wet electrostatic dust precipitators, there is a tendency to be enlarged in size, so that installation places therefore have been often restricted to, for example, large factories and power generating plants. In the case of the cartridge type, in an environment where a large amount of polluted air is processed in a batch, whenever collection efficiency falls, the replacement of the cartridge has to be frequently done, whereby operator's labor burden, replacement costs, and the like increase, therefore potentially making the processing uneconomical. Further, there has been a demand for an electrostatic dust precipitator that has a compact shape installable in a kitchen of a restaurant or the like and that enables it to secure high collection efficiency. In view of the situations as described above, the present applicant invented an electrostatic dust precipitator having a novel configuration and already submitted a patent application therefore (Japanese Patent Application Laid-Open No. 2003-126729).

Accordingly, under these circumstances, an object of the present invention is to provide an electrostatic dust precipitator that is formed into a compact shape and hence installable even in a narrow place and that has low probability of reducing the collection capability of collecting the fine particulate and generation efficiency of corona discharges even during and after a long-time operation.

DISCLOSURE OF THE INVENTION

An electrostatic dust precipitator of this invention comprises: a housing including an internally formed air path communicating between an inlet for drawing polluted air containing fine particulate and an outlet for emitting clean air purified by removing the fine particulate; airstream generating means that causes generation of an airstream in the air path, that draws the polluted air, and that emits the clean air; discharging means that is provided in the air path and that charges the fine particulate contained in the polluted air by using a corona discharge; collecting means that is provided in the air path and that collects the fine particulate, which has been charged by the discharging means, by using a coulomb force; and discharge voltage supply means that is connected to the discharging means and that supplies a discharge voltage capable of generating the corona discharge, wherein the collecting means is provided downstream of the discharging means in the air path and includes: a charging unit that includes a plurality of charging plates fitted in a state where charge surfaces thereof are opposite to one another and that, by using the coulomb force, causes the fine particulate charged by the discharging means to repel from the charge surfaces; an attracting unit that includes an attraction shaft and a plurality of attracting plates, which each have a substantially disc shape, which are each inserted between mutually adjacent ones of the charging plates, and which each have an attracting surface located close to each one of the charge surfaces, and that attracts the charged fine particulate to the attracting surface by using the coulomb force; an attraction-shaft bearing unit that rotatably journals the attraction shaft of the attracting unit; and attracting-plate rotating means that is connected to the attraction shaft, thereby to axially rotate the attraction shaft and to rotate the attracting plates.

The fine particulate contained in polluted air refers to any one of those that can be exemplified as, for example, industrial waste gases exhausted from, for example, factories, and solid powders contained in exhaust gases exhausted from motor vehicles, and mist-state particulates containing much oil and moisture and exhausted from, for example, kitchens of restaurants; and the fine particulate corresponds to floating-particulate substances floating in gases. The airstream generating means generates an airstream in the air passage. For example, the means rotates a propeller (fans) connected to a driving device, such as a motor, and thereby produces airflows (airstreams) by using the rotational force of the propeller. By controlling, for example, the rotational diameter of the propeller for drawing the air, the number of rotations of a motor to be driven, the flow rate, circulation velocity, and the like of the airstream flowing in the air pipe can be appropriately varied.

The collecting means operates such that when a charge (for example, positive charge) is supplied to the fine particulate in the airstream by using the discharging means, the collecting means uses the coulomb force for the side having the electrically opposite polarity (corresponding to the negative polarity, in the present case) to thereby electrically attract and collect the fine particulate. The charging unit operates such that the fine particulate charged by the discharging means can be caused to be repelled by the action of the coulomb force with the charging plates charged to the same polarity (corresponding to the positive polarity, in the present case), whereby the fine particulate can be forcibly drawn toward the respective attracting surfaces of the attracting plates oppositely arranged.

Thus, according to the electrostatic dust precipitator of the present invention, the discharge voltage for causing the corona discharge to be generated by the discharge voltage supply means is supplied to the discharging means to thereby permit the fine particulate, which is contained in the polluted air in the airstream, to be in contact with the corona discharge generated as described above, whereby, a charge (for example, positive charge) is supplied to the fine particulate. Then, the fine particulate in the charged state reaches portions where the charging unit and the attracting unit are installed. At this time, the attracting plates of the attracting unit are set to the charge (negative) relative to the charged fine particulate, so that the fine particulate is collected attractively onto the attracting surfaces of the attracting plates by the effect of the coulomb force. In this case, the attracting plates are being rotated by the attracting-plate rotating means about the attraction shaft as the axis, the portion of the respective attracting surfaces for collecting the fine particulate changes every moment. Therefore, the collection of the fine particulate does not concentrate on one portion. Accordingly, the probability of reduction of the coulomb force associated with the concentration of the fine particulate is reduced, and thus the collection efficiency is not reduced. Consequently, the fine particulate can be collected for a long time in a stabilized manner.

In addition, the attracting plate is fitted onto the rotatable attraction shaft, so that a centrifugal force toward the rotational outer peripheral direction are being exerted on the corrected fine particulate during the rotation along the centrifugal direction on the attracting surface of the attracting plate onto which the fine particulate has been collected. Thus, when the centrifugal forces directed from the attraction shaft to the outer peripheral (centrifugal) direction oppose the attractive force of the attracting surface on which the fine particulate has been attracted, the fine particulate is separated from the attracting surface of the attracting plate and falls down through the inside of the air path under the influence of gravity. As a consequence, even in the operation state of the electrostatic dust precipitator, the fine particulate is removed in a natural manner from the attracting plate by the rotation of the attracting plate, whereby the number of cleaning operations for the attracting surfaces of the attracting plates can be reduced.

In addition, in the electrostatic dust precipitator of the present invention, the charging plate of the charging unit and the attracting plate of the attracting unit are formed such that the charge surface and the attracting surface are close to one another. In addition, the charging plate having the charge surface is supplied with the repellent force so as to be electrically at the same potential as the charged fine particulate. As a consequence, since the charged particulate approaching the charging plate electrically has the same polarity, the repellent force according to the coulomb force acts to thereby disable the fine particulate to approach the charging plate, such that the fine particulate is about to escape from the charging plate. In other words, the fine particulate is forced to approach by the coulomb force along a certain direction of the attracting plate. Thereby, the collection efficiency for the fine particulates on the attracting surface can be enhanced. Further, since the charge of the fine particulate charged by the discharging means is gradually discharged over time, the charged fine particulate enters the electrically neutral state. Therefore, depending on the case, the drawing effect according to the coulomb force cannot be sufficiently exhibited. However, by causing the fine particulate to be repelled by using the charging plate and to approach the attracting plate, it becomes possible to cause attraction of the fine particulate even in the state where discharging of the charge has just started. The shape of the charging plate is not specifically limited, but may be, for example, a square planer shape so that the entirety of the attracting surface of the attracting plate being rotated is coated. Furthermore, the electrostatic dust precipitator of this invention is that the discharging means includes: a discharging unit that includes a discharge shaft and a plurality of discharge plates which each have a substantially disc shape and which are fitted to a shaft periphery of the discharge shaft in a state where discharge surfaces thereof are located opposite to one another; a discharge-shaft bearing unit that rotatably journals the discharge shaft of the discharging unit; discharge-plate rotating means that is connected to the discharge shaft, thereby to axially rotate the discharge shaft and to rotate the discharge plates; and a discharge guide unit including a plurality of discharge guides that are each inserted between mutually adjacent ones of the discharge plates and that each have a discharge guide surface located close to the discharge surface, wherein the discharging unit is electrically connected to the discharge voltage supply means, causes generation of the corona discharge between each one of the discharge surfaces of the discharge plates rotated by the discharge-plate rotating means and each one of the discharge guide surfaces of the discharge guides, and charges the fine particulate contained in the polluted air passing through between the each one of the discharge surfaces and the each one of the discharge guide surfaces.

Thus, according to the electrostatic dust precipitator of the present invention, the corona discharge can be generated in accordance with the discharge shaft between the rotatable discharge plate and the discharge guide having the discharge guide surface close to the discharge surface of the discharge plate. Thereby, the fine particulate in the polluted air flowing between the discharge plates and discharge guides is charged to be positive, for example. In this event, the discharge plates are rotated by the discharge-plate rotating means, so that the corona discharge is not generated from a single portion in a concentrated manner. The discharge plate has a plurality of discharge projections formed in order to facilitate the generation of the corona discharge. Thus, the corona discharge can be generated from a plurality of portions between a single discharge plate and a single discharge guide opposite thereto, thereby enabling efficiently charging the fine particulate contained in the polluted air. In addition, the rotation of the discharge plate makes it possible to successively cause relative alterations in the position of the discharge projection of the discharge plate and the position of the discharge guide opposite thereto. Accordingly, the portion between the discharge plate and the discharge guide can be prevented from entering a continuous leak (arc discharge) state with high voltage. As a consequence, the probability of causing, for example, the discharge projections to be heated or to be worn or deteriorated due to the corona discharge is reduced, consequently making it possible to increase the service life of the discharge plate. Thereby, the frequency of replacement of the discharge plate can be prolonged, and costs necessary for maintenance such as replacement can be reduced.

Still further, the electrostatic dust precipitator of this invention is that an engineering plastic material containing glass fiber and having heat/flame resistance and electric insularity to the housing is used for at least any one of the discharge-shaft bearing unit of the discharging unit and the charge shaft that supports the charging plates of the charging unit.

Examples of the engineering plastic material include, for example, a polyamide resin, polyaramide resin, polyacetal resin, polycarbonate resin, and fluorine resin. These materials have not only the above-described heatflame resistance and electric insularity, but also characteristics, such as high strength, high resiliency, and wear resistance, so that the materials are used in a large variety of industrial products. Especially, a fiber reinforced engineering plastic material, which is formed to contain glass fiber in the inside, has characteristics reinforced with, for example, heat resistance of the glass fiber.

Thus, according to the electrostatic dust precipitator of the present invention, the engineering plastic material having the electric insularity is used as a material. This makes it possible to restrain the occurrence of such cases in which the apparatus is exposed to a high voltage that can lead to accidents and failure in a portion having high risks of electric leak and the like. Generally, as electrically insulative materials, although ceramic materials are generally used, problems can occur in terms of cost and weight. However, by using, particularly, a fiber reinforced engineering plastic material having the characteristics of glass fiber, the apparatus can be rendered to have a reduced weight and high workability, thereby making it possible to improve reliability and the like of electrostatic dust precipitators.

Still further, the electrostatic dust precipitator of this invention is that at least any one of the discharge-shaft and the charge shaft that supports the charging plates of the charging unit is configured into a labyrinth structure that prevents intrusion of conductive media including water.

Thus, according to the electrostatic dust precipitator of the present invention, at least one of the discharge-shaft bearing unit and the charge shaft is formed into the labyrinth structure. The labyrinth structure prevents intrusion of conductive medium that has electric conductivity, such as water, dusts, and solvents. Especially, the discharge-shaft bearing unit and the charge shaft have to apply high voltage to the discharge shaft and the charging plates and to charge the fine particulate with the corona discharge, thereby causing the fine particulate to be repelled. However, since a later-described cleaning solvent or the like is injected into the air path, conductive mediums such as water tend to remain in the air path. Thus, it is assumed that there are risks of accidents, such as electric leak, associated with the conductive mediums in the discharge-shaft bearing unit and charge shaft. For this reason, the corresponding portions are formed into the labyrinth structure, whereby the probability of intrusion of the conductive mediums into the bearing units and the like is reduced, and hence the risk of electric leak to the housing can be avoided.

Still further, the electrostatic dust precipitator of this invention further comprising a rectification guide that divides and rectifies the polluted air drawn by the airstream generating means from the inlet and guides the polluted air to the discharging unit.

Thus, the electrostatic dust precipitator of the present invention includes a rectification guide that rectifies and derives the airstream drawn from the inlet to the discharging unit. More specifically, the airstream drawn from the inlet by the airstream generating means, generally, tends to flow so as to diffuse over the entirety of the interior of air path. For this reason, there is a probability that the flow rate of the airstream flowing between the discharge plate of the discharging unit and the discharge guide is reduced. Accordingly, there is a probability that the discharge efficiency with the corona discharge is reduced. Further, in the vicinity of the inlet, it is also assumed that the airstream generated by the airstream generating means becomes turbulent (turbulent flow). Thus, the rectification guide is provided upstream of the discharging unit in the air path. Thereby, the airstream in the polluted air containing the fine particulate drawn from the inlet can be divided, rectified, and then circulated between the discharge plate and the discharge guide so that the discharge efficiency can be enhanced.

Yet further, the electrostatic dust precipitator of this invention further comprising: cleaning solvent injection means for injecting a cleaning solvent to at least any one of the discharge surfaces of the discharge plates and the attracting surfaces of the attracting plates; and cleaning rotation control means for rotating at least any one of the discharge plates and the attracting plates during injection of the cleaning solvent by the cleaning solvent injection means.

Thus, according to the electrostatic dust precipitator of the present invention, the cleaning solvent is injected to the discharge surface or attracting surface of the discharge plate or attracting plate in the state rotated by the cleaning rotation control means. Thereby, the fine particulate contained in the polluted air collected onto the attracting surface or the discharge surface is washed. In this event, the discharge plate and the attracting plate is rotationally controlled, so that the cleaning solvent can be injected on the overall attracting surface and discharge surface by directing an injection nozzle to at least one portion of the attracting surface or the discharge surface by the cleaning solvent injection means. That is, cleaning can be accomplished without shifting the direction of the cleaning nozzle or the like provided in the cleaning solvent injection means. In addition, with the rotation of the discharge plate and the attracting plate, the cleaning solvent injected on the respective surfaces is moved with dirt along the circumference direction, and is then scattered by the centrifugal force. As a result, dirt on the discharge surface and the attracting surface is removed, and draining can be accomplished at the same time. Thereby, the electrostatic dust precipitator can be operated again in a short time after cleaning.

As advantageous effects of the present invention, the discharging means including the discharging unit and the discharge guide unit for charging the fine particulate with the corona discharge and the collecting means for collecting the charged fine particulate are separately provided in the air path, in which the fine particulate can be caused to repel toward the attracting plate in the charged state by using the charging unit provided in the collecting means. As a consequence, the efficiency of collection of the fine particulate being collected onto the attracting surface of the attracting plate can be enhanced. Further, the airstream drawn from the inlet can be securely derived by the rectification guide in the form of a stabilized flow into the portion between the discharge plate and the discharge guide. Consequently, the discharge efficiency can be enhanced.

BEST MODE FOR CARRYING OUT THE INVENTION

Figure 1:
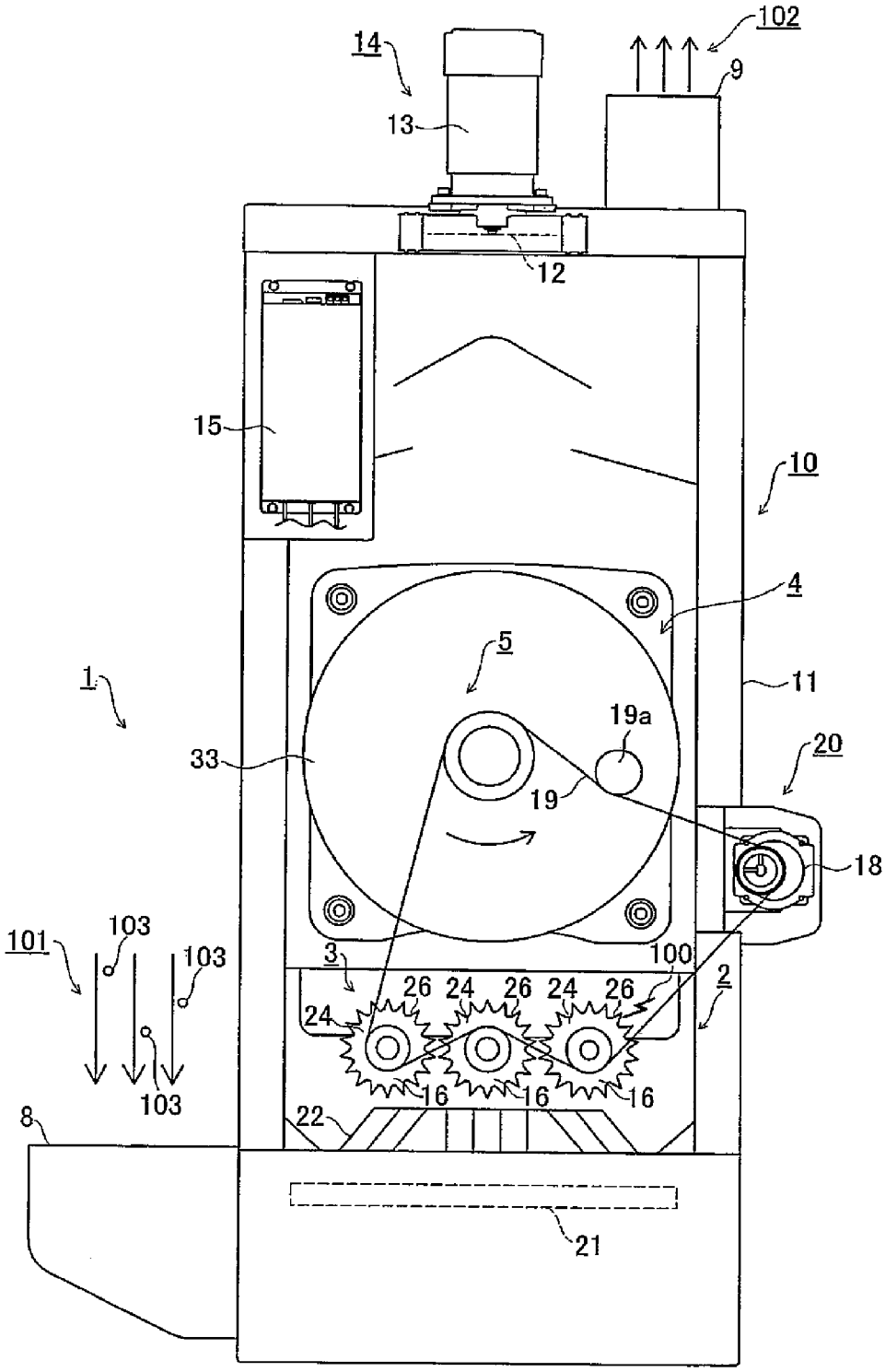
FIG. 1 is a view showing a schematic configuration of an electrostatic dust precipitator, viewed from front.
Figure 2:
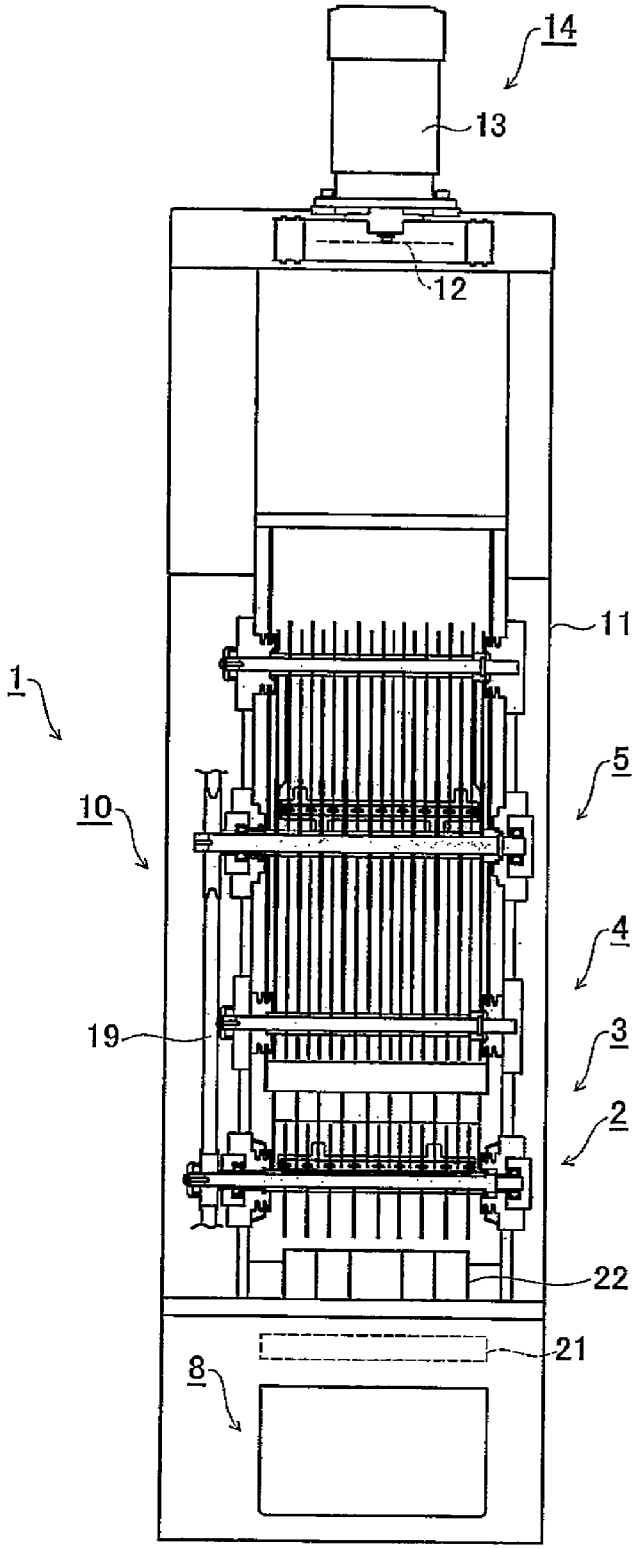
FIG. 2 is a view showing a schematic configuration of an electrostatic dust precipitator, viewed from side.
Figure 3:
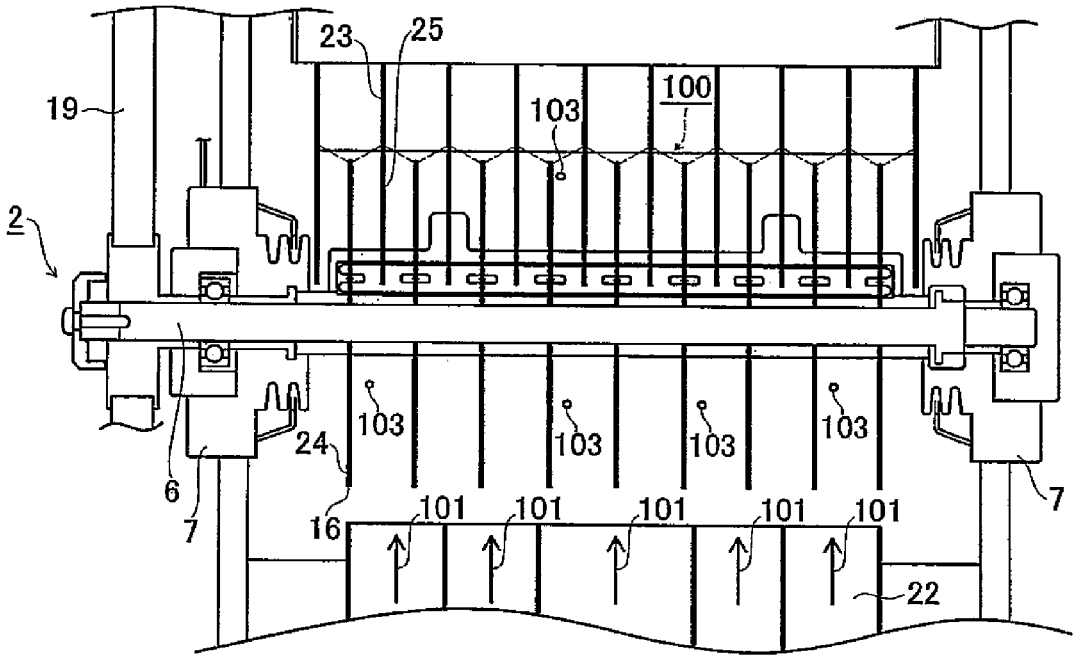
FIG. 3 is a view explaining configurations of a discharging unit and a discharge guide unit.
Figure 5:
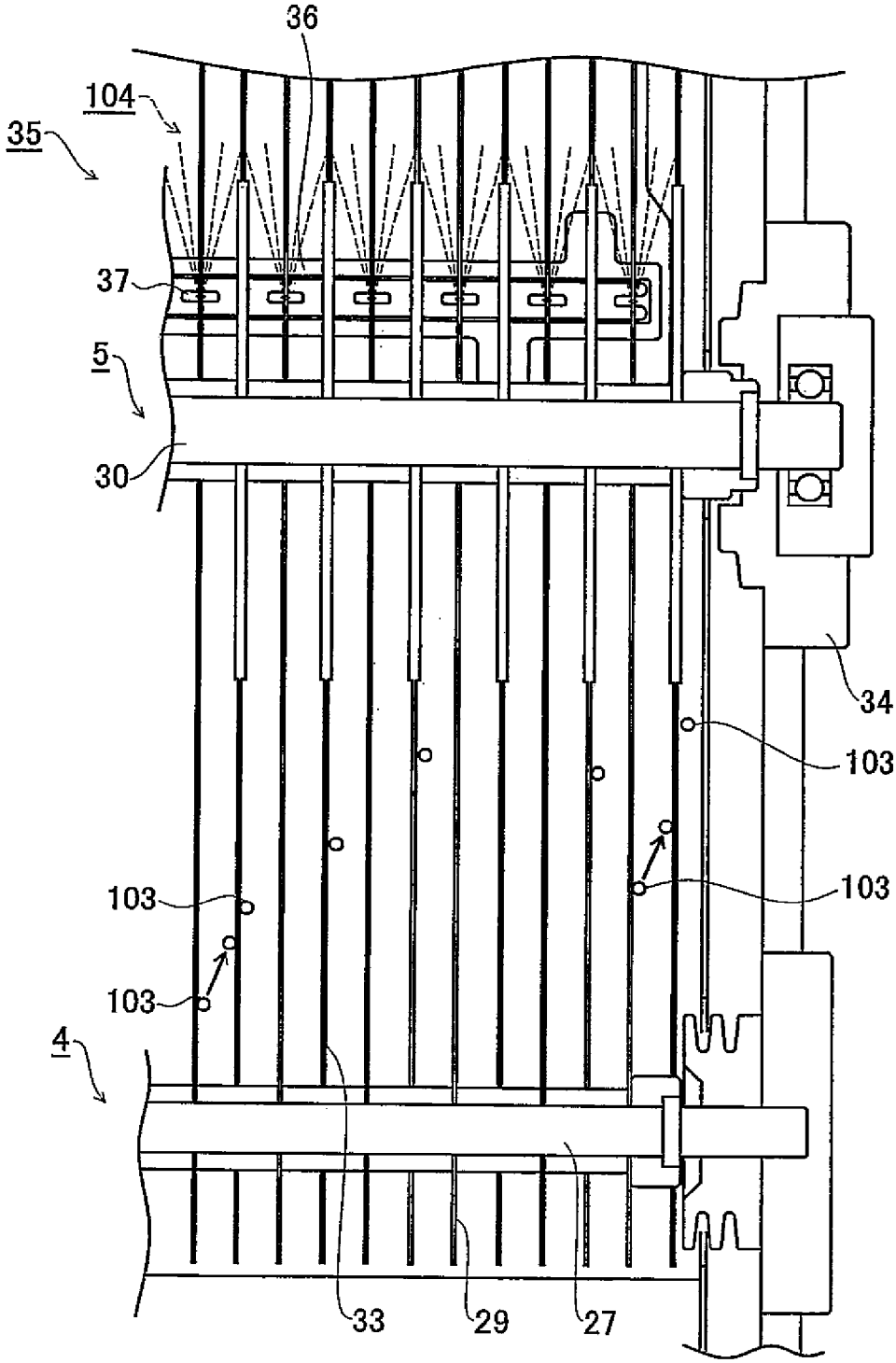
FIG. 5 is a view showing behavior of fine particulate in the charging unit and the attracting unit.
Figure 4:
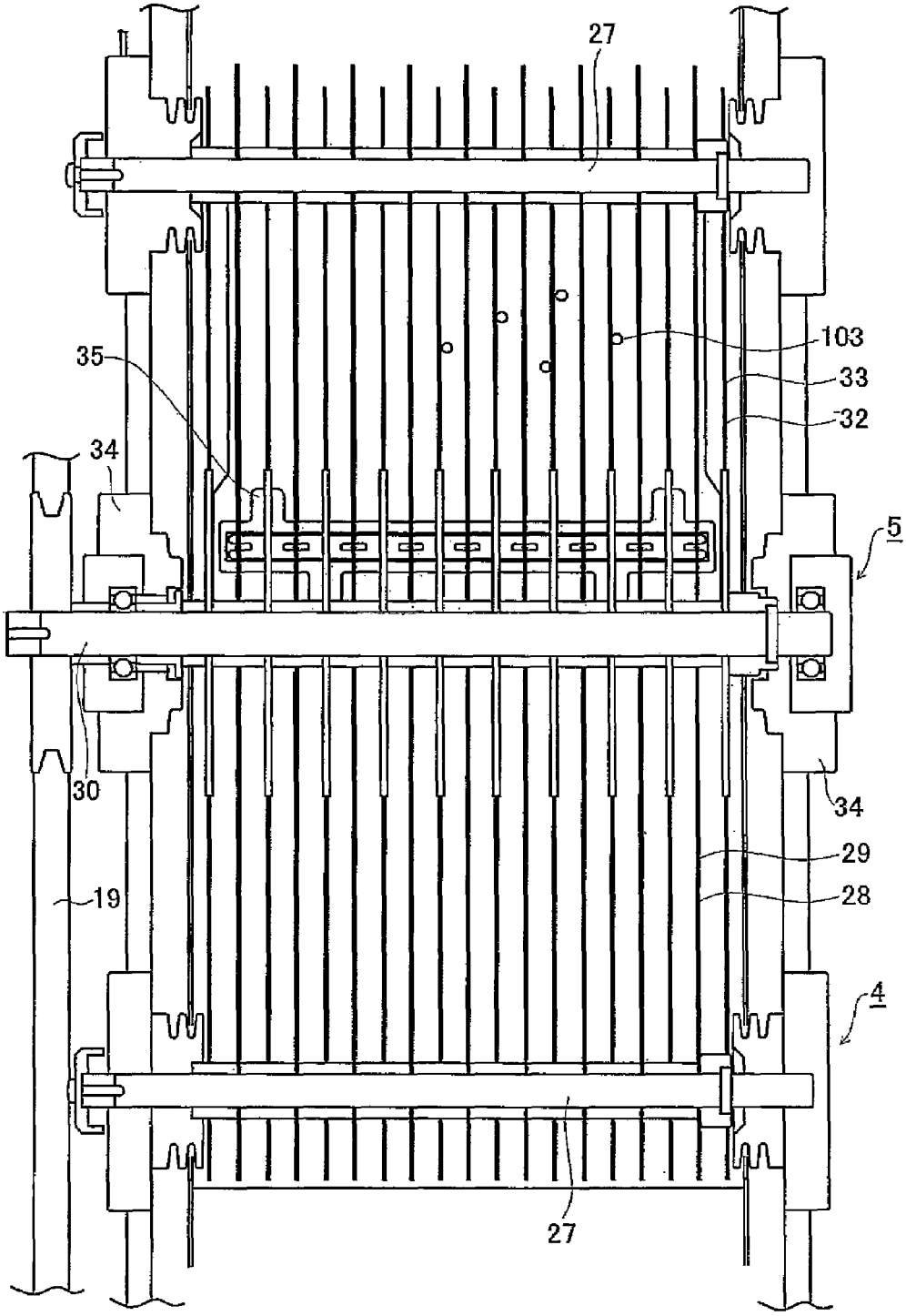
FIG. 4 is a view explaining configurations of a charging unit and an attracting unit.

As one embodiment of the present invention, an electrostatic dust precipitator 1 will be described herebelow with reference to FIGS. 1 to 5.

The electrostatic dust precipitator 1 according to one embodiment of the present invention, is constructed mainly to include a housing 11, an airstream generating unit 14, discharging units 2, a discharge guide unit 3, a charging unit 4, an attracting unit 5, and a drive controller unit 20. The housing 11 has an air path 10 formed therein to communicate between an inlet 8 for drawing polluted air 101 containing fine particulate 103, and an outlet 9 for emitting purified clean air 102. The airstream generating unit 14 has a rotating fan 12 and a fan driving motor 13, in which the rotating fan 12 draws the polluted air 101 from the inlet 8 and generates an airstream within the air path 10, thereby to emit the clean air 102 from the outlet 9. The discharging units 2 and the discharge guide unit 3 are disposed upstream of the air path 10 (which corresponds to a lower side of the drawing sheet of FIGS. 1 and 2) and brings corona discharge 100 in contact with the fine particulate 103 contained in the polluted air 101, thereby to charge the positive polarity. The charging unit 4 uses coulomb force and thereby causes repulsion of the fine particulate 103 charged by the corona discharge 100. The attracting unit 5 uses coulomb force to cause the fine particulate 103, which has been repulsed by the charging unit 4, to be attracted, thereby to collect the fine particulate 103. The drive controller unit 20 includes a voltage supply unit 15 for supplying discharge voltages used for generating the corona discharge 100 and for the repulsion by the charging unit 4 using the coulomb forces; a rotational-driving motor 18 for rotationally driving discharge plates 16 of the discharging units 2 and an attracting plate 33 of the attracting unit 5; a driving belt 19 for rotating the discharge plates 16 and the attracting plate 33 in cooperation with one another in the manner that the rotation of the rotational-driving motor 18 is synchronized with respective one of them; and a tension roller 19*a* for providing tension to the driving belt 19. The airstream generating unit 14 corresponds to the airstream generating means in the present invention; the voltage supply unit 15 corresponds to discharge voltage supply means in the present invention; and drive controller unit 20 including the rotational-driving motor 18 and the driving belt 19 corresponds to discharge-plate rotating means and attracting-plate rotating means in the present invention.

More specifically, the electrostatic dust precipitator 1 of the present embodiment includes a filter unit 21 and a rectification guide 22. The filter unit 21 is located near the inlet 8 of the air path 10, and physically filters the polluted air 101 to remove large foreign matter (not shown) contained in the polluted air 101. The rectification guide 22 is located downstream of the filter unit 21; and it divides the polluted air 101 drawn from the inlet 8, rectifies the flows thereof, and thereby guides the flow between the discharging units 2 and the discharge guide unit 3 in the air path 10. The discharging unit 2 is configured mainly to include a discharge shaft 6 disposed to extend to the air path 10; and a plurality of discharge plates 16 respectively fitted onto the respective discharge shaft 6 in the state where discharge surfaces 24 are spaced away from one another at a predetermined pitch interval. The discharge plate 16 is formed into a substantially disc shape to have a plurality of discharge projections 26 for facilitating generation of the corona discharge 100. Three discharging units 2 are juxtaposed in such a manner as to block the air path 10. The discharge shafts 6 of the discharging units 2 are each journaled by discharge-shaft bearing units 7 electrically insulated from the housing 11, and are in connection with one another and with the driving belt 19 of the drive controller unit 20 that serves to rotate the discharge plates 16 through the voltage supply unit 15 and the discharge shafts 6 that are provided to generate the corona discharge 100.

The discharge guide unit 3 is formed to include discharge guides 23 that are each inserted between the discharge plates 16 of the discharging unit 2, which are spaced away from one another at the predetermined pitch, and that are close to one another by maintaining the state where the discharge surface 24 of the discharge plate 16 and a discharge guide surface 25 are substantially parallel to one another. The discharge guide unit 3 is installed immediately downstream of the discharging units 2 installed in the air path 10, and is formed in the manner that, as viewed from the lateral side, the discharge plate 16 and the discharge guides 23 overlap with one another. The discharge shaft 6 of the discharging unit 2 is rotatably journaled by the discharge bearing units 7, which are electrically insulated from the housing 11, and is connected to the above-mentioned voltage supply unit 15. Thus, a high voltage (set to 10.5 kV, in the present case) supplied by the voltage supply unit 15 for generating the corona discharge 100 is supplied to the discharge shafts 6 and the discharge plates 16. On the other hand, the discharge guide unit 3, which includes the electric discharge guides 23, is connected to the ground (not shown) in the state where it is electrically insulated from the housing 11. Accordingly, a potential difference occurs between the discharge plate 16 and the electric discharge guide 23, whereby the corona discharge 100 is generated from the discharge projection 26 of the discharge plate 16 toward the discharge guide surface 25 of the electric discharge guide 23. In this event, the discharge plate 16 fitted to the discharge shaft 6 is being rotated with the discharge shaft 6 in accordance with the driving controller unit 20. For this reason, the position of the discharge guide 23 with respect to the discharge projections 26, which generate the corona discharge 100, is relatively changing at all times. Therefore, the corona discharge 100 is not generated continuously at one portion, thereby enabling extension of the service lifetimes of the discharge plates 16 and the discharge guides 23.

The generation efficiency of the corona discharge 100 is significantly dependent on the value of the voltage supplied by the voltage supply unit 15 and on the distance of an electric field formed between the electrodes (namely, between the discharge plate 16 and the discharge guide 23). In addition, generally, the corona discharge 100 has the tendency of occurring from a portion having a shape with protruding end or tip. Accordingly, in the electrostatic dust precipitator 1 of the present embodiment, the discharge surface 24 of the discharge plate 16 and the discharge guide surface 25 of the discharge guide 23 are arranged close to one another, and the plurality of protruding discharge projections 26 are provided at least along the circumference direction of the discharge plate 16. Thereby, the situation facilitating the generation of the corona discharge 100 is created. Consequently, while circulating among the discharge plates 16 and the discharge guides 23, the polluted air 101, which has been rectified by the rectification guide 22 and guided to the discharging units 2 and the discharge guide unit 3, are almost certainly exposed to the corona discharge 100. Consequently, the fine particulate 103 in the polluted air 101 in an electrically neutral state is charged by the corona discharge 100 into an electrically positive state. Particularly, the plurality of discharge plates 16 and the plurality of discharge guides 23 are arranged in the sir path 10, and the polluted air is guided to the discharging unit 2 without causing turbulent flows through the rectification guide 22. Consequently, compared with a conventional electrostatic dust precipitator, the charge efficiency of the fine particulate 103 can be significantly enhanced.

Further, the charging unit 4, which is provided downstream of the discharging unit 2 and the discharge guide unit 3, is constructed mainly to include a plurality of substantially square charging plates 29 that are fixedly supported by charge shafts 27 at four corners and that are arranged such that charge surfaces 28 thereof are opposed to one another. The charge shafts 27 are fitted in a state where they are electrically insulated from the housing 11, and are connected with the voltage supply unit 15. A repellent voltage of 11.5 kV is supplied from the voltage supply unit 15, whereby the fine particulate 103 is brought into the electrically positive state. This enables the charged fine particulate 103 approaching the charging plate 29 to be repelled therefrom through the coulomb force. Through-hole portions (not shown) through which the attraction shaft 30 of the attracting unit 5, which is described further below, can be passed, are provided in portions near the substantially centers of the respective charging plates 29. The attracting unit 5 is constructed to include the attraction shaft 30 provided to extend to the air path 10 in the state where it passes through the through-hole portions (not shown) of the charging plates 29; the attracting surfaces 32 inserted in between adjacent ones of the plurality of charging plates 29 arranged to be away from one another and arranged in proximity to and parallel to the respective charge surfaces 28; and a plurality of substantially disc-shaped attracting plates 33 fitted onto the shaft periphery of the attraction shaft 30. The attraction shaft 30 of the attracting unit 5 is journaled by attraction-shaft bearing units 34, and is connected with the driving belt 19 of the driving controller unit 20 that serves to rotate the attracting plates 33. In addition, the attracting plates 33 are connected to the ground (not shown), similarly to the discharge guide unit 3.

With the construction described above, the discharging unit 2 and the charging unit 4 connected to the voltage supply unit 15 are in the state where the positive charges are applied through the respectively supplied discharge voltage (set to 10.5 kV) and repellent voltage (11.5 kV). On the other hand, the discharge guide unit 3 and attracting unit 5 respectively connected to the ground are relatively in the negative states. Thereby, the fine particulate 103 charged by the corona discharge 100 to be positive can be drawn near to the negative electrode side, whereby, particularly, the fine particulate 103 is attracted by the attracting plates 33. Since the discharge guide unit 3 and the attracting unit 5 are connected to the ground, the potential of the collected fine particulate 103 escapes to the surface of the earth as it is, the charges are not accumulated in the electrostatic dust precipitator 1.

In order to be electrically insulated from the housing 11, the discharge bearing units 7 and the charge shafts 27, which are used to supply the discharge voltage and the repellent voltage to respective ones of the discharge plates 16 and charging plates 29, are formed of an engineering plastic material containing glass fiber. Further, as primarily shown in FIG. 5, the discharge bearing units 7 and the charge shafts 27 are formed in a labyrinth structure. Thus, matters such as water and impurity having high conductivity are prevented from intruding between the discharge bearing unit 7 or the respective charge shaft 27 and the housing 11, whereby, when the electrostatic dust precipitator 1 is brought into the operating state, electric leak does not occur between the discharge bearing units 7 or the like and the housing 11. On the discharge shaft 6, a bearing (not shown) is provided on the shaft periphery in contact with the discharge bearing unit 7, whereby even during the rotation by the driving controller unit 20, the discharge voltage can be supplied to the discharge plate 16.

In addition, the electrostatic dust precipitator 1 of the present invention includes a cleaning device 35 for physically removing the fine particulate 103 attached or collected on the discharge surfaces 24 of the discharge plate 16 and the attracting surfaces 32 of the attracting plates 33. More specifically, the cleaning device 35 is constructed to include a lengthy cleaning device mainbody 36 disposed to extend to the air path 10, and a plurality of injection nozzles 37 for injecting a cleaning solvent 104 to the respective surfaces 24 and 32 of the discharge plate 16 and the attracting plate 33. The injection nozzles 37 are each provided along an extension line in the circumferential direction of the substantially disc-shaped discharge plate 16 or attracting plate 33. The injection nozzles 37 have a distribution function for injecting the cleaning solvent 104 along two directions at the same time to the surfaces 24 and 32 of the respective plates 16 and 33 adjacent to one another. Further, in the event of injection of the cleaning solvent 104, the drive controller unit 20 drives the discharge plate 16 and attracting plate 33 to rotate. The cleaning device 35 corresponds to cleaning solvent injection means of the present invention, and the driving controller unit 20 corresponds to cleaning rotation control means of the present invention.

A using method of the electrostatic dust precipitator 1 of the present embodiment will now be described herebelow. First, the airstream generating unit 14 is operated, and the rotating fan 12 is rotated by the fan driving motor 13. Then, the driving controller unit 20 is controlled, whereby the discharge shaft 6 and an attraction shaft 30 are rotated, and the discharge plates 16 and the attracting plates 33 are rotated in the air path 10. The rotation of the rotating fan 12 generates an airstream inside the air path 10, and causes the polluted air 101 to be drawn in from the inlet 8. Then, great foreign matters are removed through the filter unit 21, and thereafter, the polluted air 101 containing the fine particulate 103, such as further fine mist, is drawn into the air path 10. Thereafter, the polluted air reaches the rectification guide 22 provided in a portion corresponding to an uppermost steam side of the air path 10.

Depending on the case, the drawn polluted air 101 causes non-constant turbulence of the air, thereby potentially leading to turbulent airstream at the inlet 8. In addition, generally, the air tends to flow such as to diffuse outward. Thus, the electrostatic dust precipitator 1 of the present embodiment includes the rectification guide 22 that rectifies the drawn flow of the polluted air 101. Thereby, the air can be guided in the form of a stable flow without being outwardly diffused in the air path 10 to the discharging unit 2 and the discharge guide unit 3. Thereby, the polluted air 101 reaches the discharging unit 2 and discharge guide unit 3 disposed in such a manner as to block the air path 10.

The polluted air 101 having traveled past the rectification guide 22 then travels between the discharge surface 24 of the discharge plate 16 of the discharging unit 2 and the discharge guide surface 25 of the discharge guide 23 of the discharge guide unit 3. In this event, the discharge voltage (10.5 kV in the present case) is supplied to the discharge plates 16 of the discharging unit 2 from the voltage supply unit 15 through the discharge bearing units 7 and the discharge shaft 6. On the other hand, the discharge guide 23 of the discharge guide unit 3 is connected to the ground (not shown) through the housing 11. As a consequence, electric fields having a very high potential difference are formed between the two surfaces 24 and 25. Thereby, the corona discharge 100 is generated from the discharge projection 26 of the discharge plate 16, to which the discharge voltage has been applied. The fine particulate 103, which is contained in the polluted air 101 traveling between the electric fields, comes into contact with the corona discharge 100, thereby to be charged to be positive. In this event, the discharge plate 16 is rotating at a predetermined rotational speed (500 rpm, for example) about the discharge shaft 6 in the shaft center. Thus, the position of the corona discharge 100 generated from the discharge projection 26, which is protrudingly provided to the discharge plate 16, and the position of the opposite discharge guide 23 relatively change one after another. Consequently, the corona discharge 100 can be generated from a plurality of portions of the discharge surfaces 24, so that the charge efficiency is improved when charging the fine particulate 103. Further, the corona discharge 100 is not generated concentrated at a single portion, so that the occurrence of wear and deterioration of the discharge projections 26 due to the corona discharge 100 is restrained, consequently making it possible to increase the service life of the discharge plates 16. The discharge guide unit 3 has the negative charges relatively to the discharging unit 2, so that positively charged part of the fine particulate 103 is attracted onto the discharge guide surfaces 25 and is thereby collected. Further, there are cases where the fine particulate 103 is physically deposited also on the discharge plates 16 in contact with the polluted air 101.

Most of the fine particulate 103 not collected onto the discharge guide surface 25 or discharge plate 16 reaches the charging unit 4 and the attracting unit 5, which are provided downstream of the discharging unit 2 and the discharge guide unit 3. The journaled charge shafts 27 are connected to the voltage supply unit 15, whereby the repellent voltage (11.5 kV in the present case) is supplied to the charging plates 29 of the charging unit 4. Thus, they are electrically at the same potential as the fine particulate 103 positively charged by the discharging unit 2 and the like. Consequently, the coulomb force acts to generate a repellent force that does not permit the fine particulate 103 to approach the charge surfaces 28 of the charging plates 29. As a consequence, the fine particulate 103 does not come in contact with the charging plate 29. Then, the fine particulate 103 repelled from the charging plates 29 approaches the attracting plates 33 having the attracting surfaces 32 provided opposite to the charge surfaces 28 of the charging plates 29. In this event, similarly to the above-described case of the discharge guide unit 3, the attracting plate 33 is connected to the ground and generating the relatively negative charges. Thus, the fine particulate 103 is drawn by the coulomb force along the direction of the attracting plate 33. Then, the fine particulate 103 is collected onto the attracting surfaces 32 of the attracting plates 33. Thereby, the fine particulate 103 is removed from the polluted air 101, and purified clean air 102 is discharged from the outlet 9.

In this event, the attraction shaft 30 is brought into contact with the driving belt 19 of the drive controller unit 20, whereby the attracting plates 33 are being rotated in the air path 10 in synchronism with the discharge plate 16. Thus, there always occurs changing in every moment in the position of the attracting surface 32 onto which the fine particulate 103 repelled by the charging plates 29 is attracted by the coulomb force. As a consequence, the fine particulate 103 can be evenly collected on the overall attracting surface 32 of the attracting plate 33. In the event that a large amount of the fine particulate 103 is deposited on the attracting surfaces 32 and concentrated at a single portion, the deposited fine particulate 103 may reduce the effect of attractive force. However, the attracting plates 33 of the electrostatic dust precipitator 1 of the present embodiment are capable of attracting the fine particulate 103 in an averaged manner, so that compared to the case where the deposition is concentrated at the single portion, the effects of reduction in the coulomb force are not so significant. Further, the fine particulate 103 collected onto the attracting surface 32 is receiving a centrifugal force directed to the rotation circumference direction in conjunction with the rotation of the attracting plate 33. Thus, the fine particulate 103 moves together with peripheral fine particulate and the like towards the circumferential end. Then, when the centrifugal force increasingly acts in opposition to the attractive force being exerted on the attracting surface 32, the fine particulate 103 is diffused from the attracting surface 32. In this event, the fine particulate 103 is mixed with fine particulate and the like around the attracting surface 32, and the particulate 103 increases greater in the weight and size than in the collected state. As a consequence, the fine particulate 103 hardly floats again together with the purified clean air 102, so that it falls down under the influence of gravity towards a bottom wall of the air path 10. The fine particulate 103 is, therefore, never mixed with the clean air 102. Consequently, even in an operating state, the fine particulate 103 attracted onto the attracting surfaces 32 can be removed shape-wise, and thus, in comparison with the conventional electrostatic dust precipitator, the operation can be operated for a long time without cleaning or replacement of collection portions (corresponding to the attracting plates 33). Thus, it is especially preferable for the installation in a restaurant kitchen requiring a long-time operation. In addition, the discharging unit 2 and the discharge guide unit 3 for providing the corona discharge 100 are disposed separately within the air path 10 from the charging unit 4 and the attracting unit 5 for collecting the fine particulate 103. Therefore, the fine particulate 103 charged by the corona discharge 100 is deposited directly onto the discharge guides 23, so that the effects of the coulomb force are not impaired. As a consequence, a large amount of polluted air 101 can be processed for a long time.

Further, the electrostatic dust precipitator 1 of the present embodiment includes the cleaning device 35 capable of injecting the cleaning solvent 104 to the rotating discharge plate 16 and attracting plate 33. Thereby, with the injection of the cleaning solvent 104, the fine particulate 103 deposited on the discharge surfaces 24 of the discharge plates 16 and attracting surfaces 32 of the attracting plates 33 can be removed. In this case, the discharge voltage and the repellent voltage are not supplied from the voltage supply unit 15. Nevertheless, however, the discharge shaft 6 and the attraction shaft 30 are rotated via the drive controller unit 20. Accordingly, the cleaning solvent 104 injected from the injection nozzles 37 does not have to be changed for the injection direction, but can be distributed by the rotation on overall areas of the discharge surface 24 of the discharge plate 16 and the attracting surface 32 of the attracting plate 33. As a result, the attracting surfaces 32, for example, are washed or cleaned, and the attracting plates 33 with reduced collection efficiencies can be used again. Thereby, compared to conventional cases, cleaning of the attracting plate 33 is easier. Further, in the electrostatic dust precipitator 1 of the present embodiment, the discharge bearing units 7 journaling the discharge shafts 6 and the charge shafts 27 are formed into a labyrinth structure that prevents the intrusion of such matters as water. As a consequence, after the cleaning operation using the cleaning solvent 104, draining is completed only by idle rotation of the discharge plate 16 and the attracting plate 33 for several minutes, and the electrostatic dust precipitator 1 can be operated again. More specifically, conventionally, when the interior of the air path is once cleaned, the moisture has to be completely eliminated by drying, and elimination of conductive media has to be verified, or otherwise the operation cannot be started because of potential risks such as electric leak. In comparison thereto, according to the electrostatic dust precipitator 1 of the present embodiment, a long post-cleaning drying time does not have to be set, and further, the operation is possible even in a state where an amount of moisture remains within the air path 10. Therefore, the apparatus is, particularly, well suited for the use in a restaurant kitchen and the like containing a lot of moisture such as steam.

As above, while the present invention has been described with reference to the preferred embodiments, the present invention is not limited to the embodiments, but various improvements and design changes may be made without departing from the spirit and scope of the invention.

More specifically, the above description has disclosed the construction of the electrostatic dust precipitator 1 of the present embodiment, in which the discharge plates 16 and the attracting plates 33 are rotated in cooperation with the single rotational-driving motor 18 and the driving belt 19. However, the construction is not limited thereto, but may be such that the rotation is implemented in a different manner by the provision of, for example, a speed change gear set and the like. Alternatively, the construction may be such that a plurality of motors are coupled to the respective shafts 6 and 34 to thereby rotate the respective plates 16 and 33 independently. Thereby, fine adjustments can be made to provide optimal rotational speeds for charging and collection operations.

In addition, the above description discloses the construction in which the discharge voltage and repellent voltage to be supplied from the voltage supply unit 15 are set to 0.5 kV and 11.5 kV, respectively. However, of course, the present invention is not limited to the construction, but this construction may be such that the voltage is variably set depending upon the charge efficiency and the collection efficiency for the fine particulate 103.

INDUSTRIAL APPLICABILITY

As described above, according to the electrostatic dust precipitator according to the present invention, industrial waste gases exhausted from factories, mist exhausted from kitchens of restaurants, and the like matters can be purified by using the corona discharge. Especially, the electrostatic dust precipitator can be fabricated into a compact shape, so that it is well suited for use in homes and for use in businesses such as restaurants.

The invention claimed is:

1. An electrostatic dust precipitator comprising:

a housing including an internally formed air path communicating between an inlet for drawing polluted air containing fine particulate and an outlet for emitting clean air purified by removing the fine particulate;

an airstream generating means that causes generation of an airstream in the air path, that draws the polluted air, and that emits the clean air;

a discharging means that is provided in the air path and that charges the fine particulate contained in the polluted air by using a corona discharge;

a collecting means that is provided in the air path and that collects the fine particulate, which has been charged by the discharging means, by using a coulomb force; and a discharge voltage supply means that is connected to the discharging means and that supplies a discharge voltage capable of generating the corona discharge, wherein the collecting means is provided downstream of the discharging means in the air path and includes:

a charging unit that includes a plurality of charging plates fitted in a state where charge surfaces thereof are opposite to one another and that, by using the coulomb force, causes the fine particulate charged by the discharging means to repel from the charge surfaces;

an attracting unit that includes an attraction shaft and a plurality of attracting plates, which each have a substantially disc shape, which are each inserted between mutually adjacent ones of the charging plates, and which each have an attracting surface located close to each one of the charge surfaces, and that attracts the charged fine particulate to the attracting surface by using the coulomb force;

an attraction-shaft bearing unit that rotatably journals the attraction shaft of the attracting unit; and attracting-plate rotating means that is connected to the attraction shaft, thereby to axially rotate the attraction shaft and to rotate the attracting plates.

2. The electrostatic dust precipitator according to claim 1, characterized in that the discharging means includes:

a discharging unit that includes a discharge shaft and a plurality of discharge plates which each have a substantially disc shape and which are fitted to a shaft periphery of the discharge shaft in a state where discharge surfaces thereof are located opposite to one another;

a discharge-shaft bearing unit that rotatably journals the discharge shaft of the discharging unit;

a discharge-plate rotating means that is connected to the discharge shaft, thereby to axially rotate the discharge shaft and to rotate the discharge plates; and a discharge guide unit including a plurality of discharge guides that are each inserted between mutually adjacent ones of the discharge plates and that each have a discharge guide surface located close to the discharge surface, wherein the discharging unit is electrically connected to the discharge voltage supply means, causes generation of the corona discharge between each one of the discharge surfaces of the discharge plates rotated by the discharge-plate rotating means and each one of the discharge guide surfaces of the discharge guides, and charges the fine particulate contained in the polluted air passing through between the each one of the discharge surfaces and the each one of the discharge guide surfaces.

3. The electrostatic dust precipitator according to claim 2, characterized in that an engineering plastic material containing glass fiber and having heat/flame resistance and electric insularity to the housing is used for at least any one of the discharge-shaft bearing unit of the discharging unit and a charge shaft that supports the charging plates of the charging unit.

4. The electrostatic dust precipitator according to claim 2, characterized in that at least any one of the discharge-shaft and a charge shaft that supports the charging plates of the charging unit is configured into a labyrinth structure that prevents intrusion of conductive media including water.

5. The electrostatic dust precipitator according to claim 2, characterized by further comprising a rectification guide that divides and rectifies the polluted air drawn by the airstream generating means from the inlet and guides the polluted air to the discharging unit.

6. The electrostatic dust precipitator according to claim 2, further comprising:

a cleaning solvent injection means for injecting a cleaning solvent to at least any one of the discharge surfaces of the discharge plates and the attracting surfaces of the attracting plates; and a cleaning rotation control means for rotating at least any one of the discharge plates and the attracting plates during injection of the cleaning solvent by the cleaning solvent injection means.

* * * * *